United States Patent [19]

Burmeister

[11] Patent Number: 4,942,382

[45] Date of Patent: Jul. 17, 1990

[54] ELECTRICAL SWITCH MECHANISM HAVING TWO RELEASE MODES

[75] Inventor: Robert L. Burmeister, Yorba Linda, Calif.

[73] Assignee: W. P. Dawson, Inc., Brea, Calif.

[21] Appl. No.: 443,256

[22] Filed: Nov. 29, 1989

[51] Int. Cl.[5] ..... H01H 37/76; H01H 71/20

[52] U.S. Cl. ..... 337/403; 337/154; 337/407

[58] Field of Search ..... 337/4, 12, 150, 151, 337/152, 153, 154, 406, 407, 403

[56] References Cited

U.S. PATENT DOCUMENTS

| | | | |
|---|---|---|---|
| 2,310,531 | 2/1943 | Kuhn et al. | 337/152 |
| 2,416,253 | 2/1947 | Furnas | 337/152 |
| 3,287,530 | 11/1966 | Dawson | 337/403 |

FOREIGN PATENT DOCUMENTS

| | | | |
|---|---|---|---|
| 2846198 | 4/1979 | Fed. Rep. of Germany | 337/150 |

*Primary Examiner*—Leo P. Picard

*Assistant Examiner*—Nilay H. Vyas

*Attorney, Agent, or Firm*—Gene W. Arant

[57] ABSTRACT

A normally closed electrical switch mechanism having fixed and movable switch assemblies, a spring assembly urging the movable switch assembly away from engagement with the fixed switch assembly to thereby open the switch, a latch member normally securing the movable switch assembly in its position of engagement with the fixed switch assembly, and a mechanism responsive to a predetermined condition external to the switch mechanism for moving the latch member so as to allow the switch to open, is improved in the following manner. A member made of thermoplastic material is positioned between the latch member and the movable switch assembly. The thermoplastic material of that member is then responsive to an overheated condition of the internal switch circuitry for losing its structural rigidity so as to release the movable switch assembly and thereby permit the spring assembly to open the switch even though the latch member remains in place.

3 Claims, 2 Drawing Sheets

ELECTRICAL SWITCH MECHANISM HAVING TWO RELEASE MODES

BACKGROUND OF THE INVENTION

In some control applications it is necessary to employ an electrical switch which will open in response to a predetermined condition and thereby interrupt an associated circuit. The predetermined condition to which a response is required will typically be a condition occurring outside the switch itself. In some applications it has been found that contact wear resulting from repeated operation of the switch will cause an overheated condition within the switch itself. The same result may occur simply from having an overload current flowing through the switch.

SUMMARY OF THE INVENTION

According to the present invention a normally closed electrical switch mechanism has two separate and distinct release modes. In one release mode the switch opens in response to an external condition. In the other release mode the switch opens in response to internal overheating of the switch circuitry itself.

More specifically, the invention in its preferred form includes a housing having a fixed switch assembly with at least one pair of electrodes; a movable switch assembly having at least one metallic contact member adapted to engage with the electrodes for closing the switch; spring means urging the movable switch assembly away from engagement with the fixed switch assembly to thereby open the switch, the movable switch assembly including a protruding part made of a thermoplastic material; a latch member normally restraining that protruding part in order to secure the movable switch assembly in its position of engagement with the fixed switch assembly; means responsive to a predetermined condition external to the switch mechanism for moving the latch member so as to release the protruding part of the movable switch assembly and thereby allow the switch to open; and the thermoplastic material of that protruding part being responsive to an overheated condition of the internal switch circuitry for losing its structural rigidity so as to release the movable switch assembly and thereby permit the spring means to open the switch even though the latch member remains in place.

DRAWING SUMMARY

FIG. 1 is a perspective view of a prior art switch mechanism used for controlling a kiln, and is identical to FIG. 4 of U.S. Pat. No. 3,287,530 issued Nov. 22, 1966 to W. P. Dawson.

DESCRIPTION OF PRIOR ART

Figure 1:
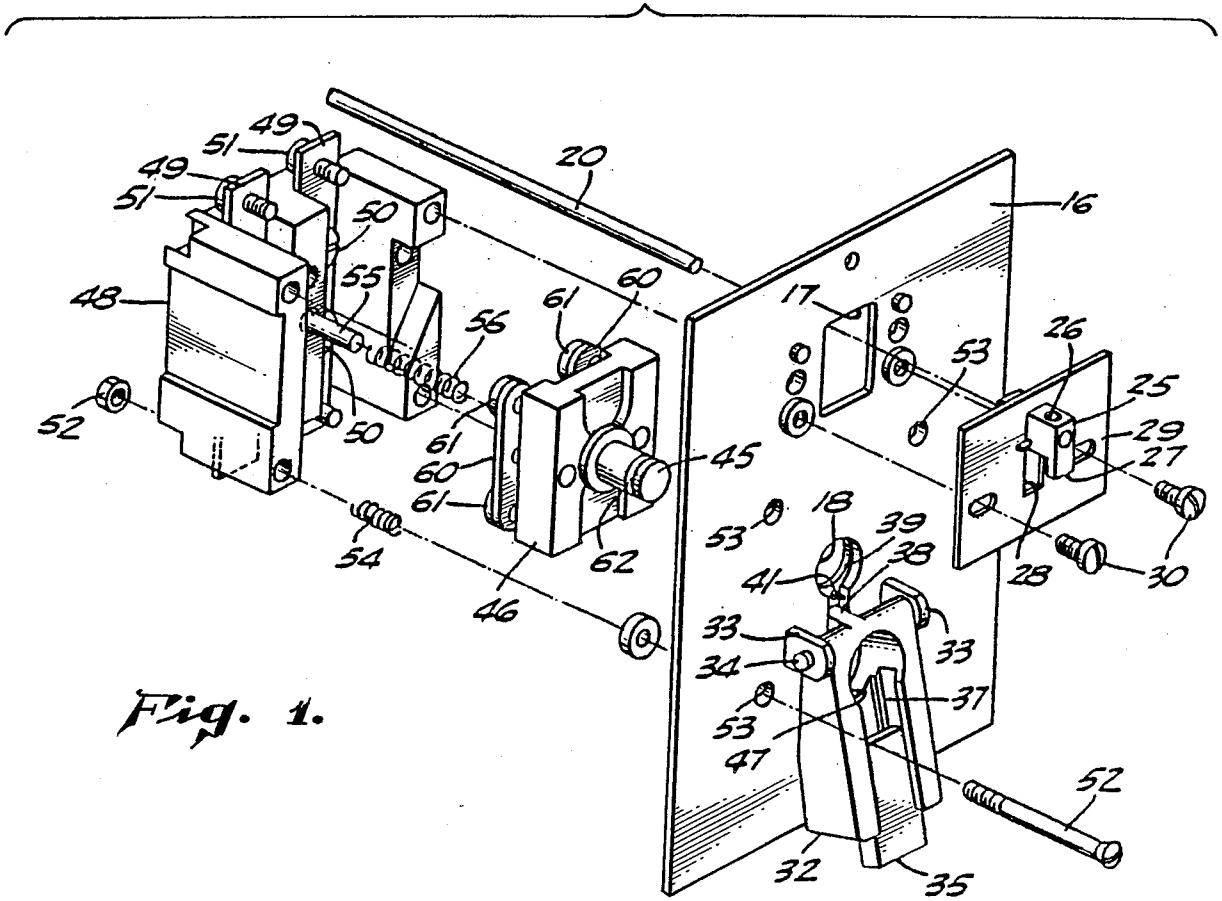

The prior art switch mechanism shown in FIG. 1 is utilized for controlling the temperature of a kiln, as explained in the Dawson patent. A housing 16 with bolts 52 supports a non-conductive ceramic block 48 which in turn forms the base for a fixed switch assembly. The fixed switch assembly includes two pairs of vertically arranged electrodes 50, each pair of which must be bridged across in order to complete one conductor of an associated electrical circuit. A movable switch assembly carried by a nonconductive ceramic plunger 46 has two pairs of metallic contact members 60 adapted to engage with those electrodes for completing the respective conductors. Each contact member 60 has a spaced pair of contact elements 61 for engagement with the electrodes 50.

A rod 55 protrudes from the center of block 48 and carries a compression spring 56, whose function is to urge the movable switch assembly away from engagement with the fixed switch assembly to thereby open the switch. However, the movable switch assembly also includes a protruding brass post 45 which has formed thereon a circumferential groove 62, and a latch plate 39 normally restrains the post 45 in order to secure the movable switch assembly in its position of engagement with the fixed switch assembly and thereby prevent the opening of the switch.

As explained in the Dawson patent, an actuating rod 20 is actuated by a pyrometric cone, not shown, when the temperature inside the kiln reaches a predetermined level. The movement of control rod 20 then releases a weight 35, which falls downward and drives a stud 38 upward for raising the latch plate 39 so as to release the post 45 of the movable switch assembly and thereby allow the switch to be opened by spring 56.

DETAILED DESCRIPTION OF PREFERRED EMBODIMENT

(FIGS. 2–5)

Movable switch assembly M is very similar to the corresponding assembly in FIG. 1, the significant difference being that the post 45′ is made of a thermoplastic material.

Figure 2:
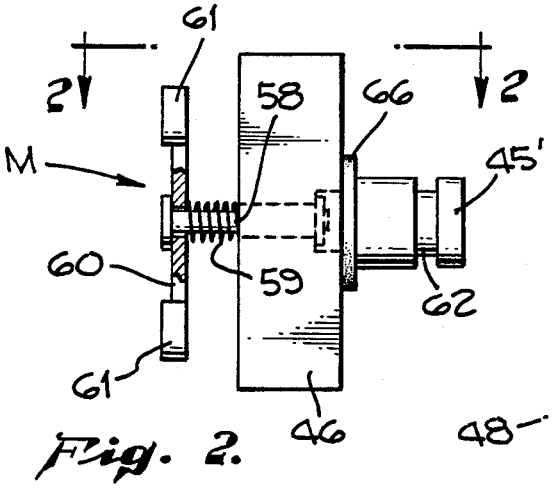
FIG. 2 is a side elevational view of a movable switch assembly M which incorporates the improvement of the present invention.
Figure 4:
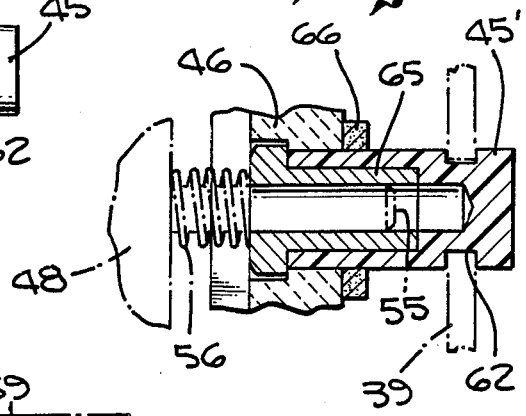
FIG. 4 is a fragmentary cross-sectional view taken on line 4—4 of FIG. 3.
Figure 3:
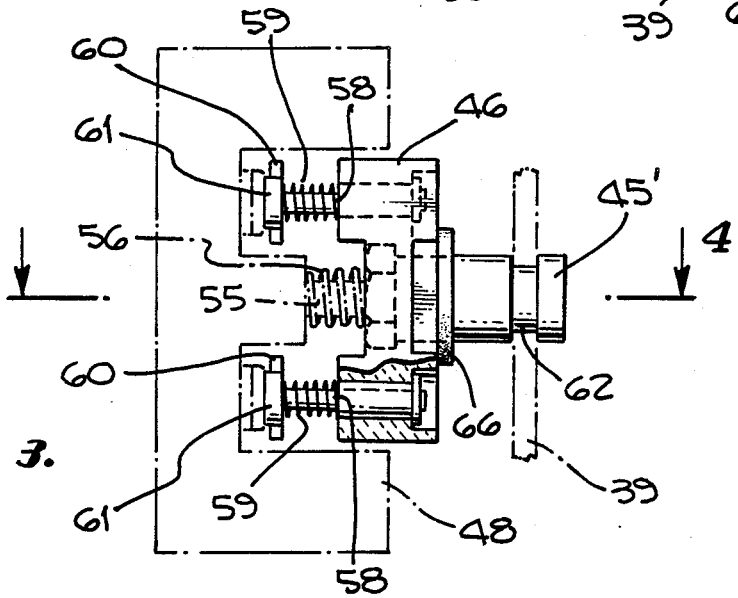
FIG. 3 is a top plan view of the entire switch mechanism in accordance with the invention, taken on Line 3—3 of FIG. 2.

The ceramic plunger 46 has parallel rods 58 which extend from its respective ends. Each rod 58 has a cap 67 on its remote end (FIG. 2), and the associated contact member 60 has a hole therein midway of its length and that hole receives the rod 58 so that the contact member 60 is captured in a slidable relation on the rod 58 such that the member may be pushed toward the plunger 46 against the force of a spring 59 which encircles the rod 58. Thus the contact elements 61 are spring-loaded and may be brought into engagement with the electrodes 50 (FIG. 1) with an appropriate amount of contact pressure.

Ceramic plunger 46 has a central opening within which the post 45′ is mounted. Post 45′ on its inner end (as would be seen in FIG. 1) is hollow, having a cylindrical opening therein. A metal fitting 65 is inserted into that hollow end of post 45′. More specifically, fitting 65 is also hollow, having a concentric cylindrical opening throughout its length. Fitting 65 also has an enlarged head end. The central opening through plunger 46 is enlarged on the side thereof which faces the fixed switch assembly. Thus, in assembly, the hollow end of post 45′ is inserted from the front side of plunger 46 through the central opening therein, then the metal fitting 65 is inserted from the other side and is driven into the inner end opening in post 45′. The two members are secured together either with mating threads, or by a press fit. A washer 66 is also press-fitted about the protruding part of post 45′ in flush engagement with the outer surface of plunger 46. Thus the post 45', metal fitting 65, and washer 66 provide an assembly which cannot easily be removed from the plunger 46.

The central rod 55 that protrudes from base member 48 acts as a guide for guiding the movement of movable switch assembly M either toward or away from the fixed switch assembly. Spring 56 surrounds the rod 55 and is kept under compression. Normally, a latch plate 39 (shown only in dotted lines in the present drawings, but shown in more detail in the Dawson patent) engages the groove 62 in the outer end of post 45' for securing the post, and hence the entire movable switch assembly, in its latched or restrained position. Thus, the switch is normally closed.

But as shown in the prior art (FIG. 1) the occurrence of an external condition may cause actuating rod 20 to move and thereby cause latch plate 39 to be moved away from its latched position, and thus allowing the switch to open under the force of spring 56.

Figure 5:
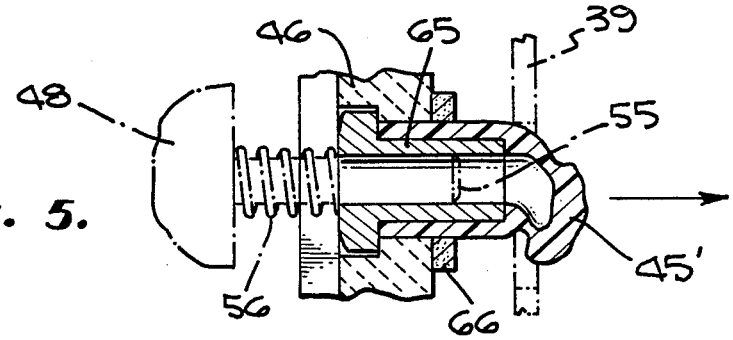
FIG. 5 is a view like FIG. 4, but showing the thermoplastic post 45 in a softened or partially melted state.

The thermoplastic post 45' provides an alternate method for releasing the switch from its closed position. An elevated temperature in the switch circuitry will cause the rod 55, spring 56, and metal fitting 65 to become heated up, thus causing heat to flow into the thermoplastic post 45'. When a sufficiently elevated temperature level exists for a sufficiently long period of time within the switch mechanism, the thermoplastic material of post 45' reaches its critical temperature, and softens to the point of nearly melting, and certainly losing its rigidity. Post 45' then no longer provides an effective spacer between plunger 46 and latch plate 39, and movable switch assembly M then moves toward its open position, as shown in FIG. 5.

Were it not for the thermoplastic post 45', an excessive amount of heat generated within the switching circuitry might be sufficient to cause the contacts 60, 50, to become welded together, thus damaging the switch so that it can no longer be used. That problem is avoided, however, by the present invention.

Post 45' may, for example, be made of a thermoplastic material known under the tradename Delrin, which loses its rigidity at a temperature of about 190 degrees Fahrenheit.

While the invention is disclosed herein as embodied in a specific type of switch mechanism, it will be readily understood that the concept of the invention may if desired be applied to other and significantly different mechanisms.

What I claim is:

1. In an automatic control for an electrically energized kiln, an improved switch mechanism adapted for manually closing an energizing circuit and including means responsive either to the occurrence of a predetermined temperature level in the firing chamber or to an overheating condition in the switch mechanism itself for opening the circuit, comprising:

a housing having a fixed switch assembly mounted thereon, said fixed switch assembly having at least one pair of electrodes;

a movable switch assembly having at least one metallic contact member adapted to engage with said electrodes for closing the energizing circuit;

spring means urging said movable switch assembly away from engagement with said fixed switch assembly to thereby open the circuit, said movable switch assembly including a post made of a thermoplastic material;

a latch member normally restraining said post for securing said movable switch assembly in its position of engagement with said fixed switch assembly;

means responsive to a pyrometric device when the firing chamber has reached a predetermined temperature level for moving said latch member so as to release said post and thereby allow the switch to open; and the thermoplastic material of said post being responsive to an overheated condition of the switch circuitry at a temperature level in the order of 150 to 200 degrees Fahrenheit for losing its structural rigidity so as to release the movable switch assembly and thereby permit said spring means to open the switch even though said latch member remains in place.

2. A normally closed electrical switch mechanism having two separate and distinct release modes, comprising:

a housing having a fixed switch assembly mounted thereon, said fixed switch assembly having at least one pair of electrodes;

a movable switch assembly having at least one metallic contact member adapted to engage with said electrodes for closing the switch;

spring means urging said movable switch assembly away from engagement with said fixed switch assembly to thereby open the switch, said movable switch assembly including a protruding part made of a thermoplastic material;

a latch member normally restraining said protruding part for securing said movable switch assembly in its position of engagement with said fixed switch assembly;

means responsive to a predetermined condition external to the switch mechanism for moving said latch member so as to release said protruding part and thereby allow the switch to open; and the thermoplastic material of said protruding part being responsive to an overheated condition of the internal switch circuitry for losing its structural rigidity so as to release the movable switch assembly and thereby permit said spring means to open the switch even though said latch member remains in place.

3. In a normally closed electrical switch mechanism having fixed and movable switch assemblies, spring means urging the movable switch assembly away from engagement with the fixed switch assembly to thereby open the switch, a latch member normally securing the movable switch assembly in its position of engagement with the fixed switch assembly, and means responsive to a predetermined condition external to the switch mechanism for moving the latch member so as to allow the switch to open, the improvement comprising:

a member made of thermoplastic material and positioned between the latch member and the movable switch assembly, the thermoplastic material of said member being responsive to an overheated condition of the internal switch circuitry for losing its structural rigidity so as to release the movable switch assembly and thereby permit the spring means to open the switch even though the latch member remains in place.

* * * * *